US007317783B2

(12) United States Patent
Dolgonos

(10) Patent No.: US 7,317,783 B2
(45) Date of Patent: Jan. 8, 2008

(54) REDUCED X-RAY EXPOSURE USING POWER MODULATION

(76) Inventor: Pavel Dolgonos, 5156 E. Weaver Dr., Centennial, CO (US) 80121

( * ) Notice: Subject to any disclaimer, the term of this patent is extended or adjusted under 35 U.S.C. 154(b) by 0 days.

(21) Appl. No.: 11/409,464

(22) Filed: Apr. 21, 2006

(65) Prior Publication Data

US 2007/0248213 A1 Oct. 25, 2007

(51) Int. Cl.
*H05G 1/22* (2006.01)

(52) U.S. Cl. ..... 378/106; 378/101

(58) Field of Classification Search ..... 378/104, 378/106, 101, 105, 113, 114, 115
See application file for complete search history.

(56) References Cited

U.S. PATENT DOCUMENTS

| | | | | |
|---|---|---|---|---|
| 5,430,641 | A | 7/1995 | Kates | |
| 5,615,093 | A | 3/1997 | Nalbant | |
| 5,619,402 | A | 4/1997 | Liu | |
| 5,909,478 | A | 6/1999 | Polichar et al. | |
| 5,930,331 | A | 7/1999 | Rentzepis et al. | |
| 6,104,146 | A | 8/2000 | Chou et al. | |
| 6,329,763 | B1 | 12/2001 | Pascente | |
| 6,816,573 | B2 * | 11/2004 | Hirano et al. | 378/114 |
| 7,151,818 | B1 * | 12/2006 | Hanington et al. | 378/104 |
| 2003/0210764 | A1 * | 11/2003 | Tekletsadik et al. | 378/106 |

OTHER PUBLICATIONS

Hernandez, Ramiro J., et al., "Reduction of Radiation Dose in Pediatric Patients Using Pulsed Fluoroscopy" May 13, 1996, AJR; 167:1247-1253.

* cited by examiner

*Primary Examiner*—Hoon Song
(74) *Attorney, Agent, or Firm*—Marsh Fischmann & Breyfogle LLP

(57) ABSTRACT

An X-ray imaging system includes an X-ray source operable to generate an X-ray beam, an X-ray receiver receiving the X-ray beam, a power generator generating power to the X-ray source to generate the X-ray beam, a grid disposed between the X-ray source and the X-ray receiver, a first pulse generator generating a first signal comprising first multiple pulses at a first pulse rate, each of the first multiple pulses having a pulse width, and a second pulse generator coupled to the grid and the power generator. The second pulse generator is configured to generate a second signal including second multiple pulses at a second pulse rate during each pulse width of the first multiple pulses, wherein the second signal is communicated to the grid to cause the X-ray beam to pulse on and off in accordance with the second signal during imaging. A method includes generating a first pulsed fluoroscopic signal having a first plurality of pulses at a first pulse rate, based on the first pulsed fluoroscopic signal, generating a second pulsed fluoroscopic signal, wherein for each of the first plurality of pulses, a second plurality of pulses is generated at a second pulse rate, and driving voltage of the gird using the second pulsed fluoroscopic signal.

29 Claims, 14 Drawing Sheets

600
608
604
610
606
602
GRIDCONTROL
GRIDFAULT
GRIDFBK
RESET/
LOW=RESET
X-RAYON
mAERR
LOW=-3.5KV ON GRID
ON GRID
-3500V/GRID
+15V
-15V
+10V
-10V
U11D MIC4469HVM
U11C MIC4469HVM
U11A MIC4469HVM
U11B MIC4469HVM
U6B 4081
U6A 4081
U6C 4081
U6D 4081
U4 LM555CM
U3 LM311
U10 LM311
U5A LF353
U5B LF353
U2B LF353
SW1
SHT 2B

REDUCED X-RAY EXPOSURE USING POWER MODULATION

BACKGROUND

Fluoroscopy is an imaging technique used by physicians to obtain real-time images of internal structures of a patient through use of a fluoroscope. A fluoroscope generally consists of an x-ray source (e.g., x-ray tube) and a fluorescent screen, between which the patient is placed. X-rays imparted on the fluorescent screen render an image of the patient's body. In conventional fluoroscopy, an x-ray beam is continuously projected from the x-ray source through the patient onto the screen for a predetermined length of time, typically ranging from 0.5-1.0 second.

Pulsed fluoroscopy is a type of fluoroscopy in which the x-ray beam is pulsed on and off during the imaging. Pulsed fluoroscopy has been shown to reduce the amount of radiation exposure to the patient. In conventional pulsed fluoroscopy, the x-ray beam is switched on and off to generate a predetermined number of x-ray pulses. Thus, for example, the x-ray beam may be switched off 50% of the time to yield a pulse rate of 12.5 pulses/second. FIGS. 1A-1B illustrate conventional fluoroscopy and conventional pulsed fluoroscopy, respectively. In one study, radiation exposure was reduced by 75% using pulsed fluoroscopy with 7.5 pulses/sec. Results of this study are published at Hernandez, R J, and Goodsitt, M M, "Reduction of radiation dose in pediatric patients using pulsed fluoroscopy," American Journal of Roentgenology, © 1996, Vol. 167, pp. 1247-1253.

A particular type of pulsed fluoroscopy is grid controlled pulsed fluoroscopy (GCPF). GCPF has been successful in further reducing x-ray exposure. GCPF involves a grid positioned inside the x-ray tube, whereby the grid acts like a valve in sharpening pulse edges. When pulse edges are sharpened, so-called "soft" radiation 106 (FIG. 1) is blocked. FIG. 1C illustrates exemplary pulses as they might appear in a GCPF system.

Even with use of pulses and a grid, patients and hospital personnel may still be exposed to harmful ionizing radiation. Government regulations directed at the medical industry set forth limits on the amount of radiation exposure that can be administered through fluoroscopy. In the United States, the legal limits generally range from 5 R/min to 20 R/min, depending on whether the fluoroscopy unit includes Automatic Exposure Rate Control (AERC) or an optional high-level control. Of course, manufacturers and users (e.g., hospitals, doctors, technicians, etc.) of fluoroscopes want to meet the legally mandated limits. However, preferably the fluoroscope would administer radiation at an exposure rate well below the legally mandated maximum, thereby reducing exposure to patients and hospital personnel, while still generating an image of sufficient quality for medical purposes.

Unfortunately, even within legal guidelines, some systems cannot deliver images of satisfactory quality, particularly for certain types of patients. As an example, suppose that 10R/min is the maximum radiation dosage allowed for a particular system, and that for an average sized patient, 90 kV of input power is sufficient to generate an image of good quality. However, a higher voltage may be required to obtain an image of satisfactory quality for a larger patient. For example, using the same system, 130 kV may be required in order to deliver an image of satisfactory quality for a large patient. Typical systems are designed to prevent exposure at above the legal limit. As a result, the system will prevent 130 kV input, which will result in a poor quality image for the larger patient.

Thus, a system and method are needed that are able to generate x-ray images of sufficient quality for a broader range of patients, while still staying within specified radiation exposure rates.

SUMMARY

Embodiments of systems and methods are described provide for generation of patient images that are of satisfactory quality, while reducing radiation exposure as compared to conventional systems. Some embodiments provide for bursted pulse progressive fluoroscopy. Various embodiments generate bursts of multiple pulses. The pulses of each burst can be generated at a higher pulse rate than traditional pulsed fluoroscopy. Some embodiments provide for modifying a first pulsed fluoroscopic signal, wherein each of the first pulses is divided or "chopped" into a plurality of pulses. As a result, embodiments can provide as good or better quality images than conventional systems, without increasing the radiation exposure rate.

An embodiment of an X-ray imaging system includes an X-ray source generating an X-ray beam, an X-ray receiver receiving the X-ray beam, a power generator generating power to the X-ray source to generate the X-ray beam, a grid disposed between the X-ray source and the X-ray receiver, a first pulse generator generating a first signal including first multiple pulses at a first pulse rate, each of the first multiple pulses having a pulse width, and a second pulse generator coupled to the grid and the power generator, the second pulse generator generating a second signal including second multiple pulses at a second pulse rate during each pulse width of the first multiple pulses, wherein the second signal is communicated to the grid to cause the X-ray beam to pulse on and off in accordance with the second signal during imaging. In one embodiment, the X-ray imaging system includes a fluoroscope.

An embodiment of a second pulse generator can generate the second signal by receiving the first signal and replacing each of the first multiple pulses with the second multiple pulses at a second pulse rate. In some embodiments of the X-ray imaging system the first pulse generator comprises a computer and the second pulse generator comprises a modular assembly configured to be coupled to a communications port of the computer. In some embodiments of the X-ray imaging system the first pulse rate is in a range extending from one pulse per second to thirty pulses per second.

In some embodiments of the X-ray imaging system the second pulse rate is adjustable. In some embodiments, the second pulse rate is in a range extending from 2 kiloHertz (kHz) to 20 kHz. Power from the power generator to the X-ray source remains substantially unchanged during imaging in accordance with at least one embodiment. In these and other embodiments, the radiation exposure rate associated with imaging may be in a range extending from 0.1 Roentgen (R) per minute to 2.0 R per minute.

One embodiment of a grid controller for a grid controlled pulsed fluoroscopic apparatus includes a grid interface connected to a computing device and receiving the first pulsed fluoroscopic signal therefrom, and a grid switch module connected to a cathode of the high voltage power supply. The grid switch module is further connected to the grid interface and receives the first pulsed fluoroscopic signal therefrom, and generates a second fluoroscopic signal by dividing each of the pulses in the first fluoroscopic signal into a plurality of second pulses at a higher pulse rate than the first pulse rate, wherein the x-ray beam is thereby pulsed from the x-ray tube according to second pulses in the second fluoroscopic signal.

In accordance with an embodiment of a grid controller, the grid interface translates an electric signal from a computing device into an optical signal and transmits the optical signal to the grid switch module via fiber-optic cable. The grid switch module may be operable to allow for adjustment of the second pulse rate. The second pulse rate may be in a range from 2 kHz to 20 kHz. In accordance with one embodiment, the x-ray beam having pulses at the second pulse rate result in a radiation exposure rate in a range from 0.1 Roentgen (R) per minute to 2.0 R per minute.

An embodiment of the grid controller may have the grid interface and the grid switch module housed in a casing having a first communications port coupled to the grid interface, wherein the first communications port is compatible with a second communications port of the communications device. The high voltage power remains substantially unchanged during pulsing of the x-ray beam in accordance with at least one embodiment.

An embodiment of a method for controlling an x-ray beam generated by an x-ray source in a fluoroscope includes generating a first pulsed fluoroscopic signal having a first plurality of pulses at a first pulse rate, based on the first pulsed fluoroscopic signal, generating a second pulsed fluoroscopic signal, wherein for each of the first plurality of pulses, a second plurality of pulses is generated at a second pulse rate, and driving voltage of the gird using the second pulsed fluoroscopic signal. Generating the second pulsed fluoroscopic signal may include replacing each of the first plurality of pulses with a second plurality of pulses at the second pulse rate.

In one embodiment, the step of driving voltage of the grid may include receiving high power voltage from a high power voltage source, and modulating the high power voltage with the second pulsed fluoroscopic signal. The step of generating the second pulsed fluoroscopic signal may involve generating the second plurality of pulses at a pulse rate ranging from 2 kHz to 20 kHz. In some embodiments, the first pulse rate ranges from one pulse per second to 30 pulses per second. In accordance with these and other embodiments, the first fluoroscopic pulsed signal is may be received electrically via a wire, and the method further includes converting the first fluoroscopic pulsed signal to an optical signal.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

BRIEF DESCRIPTION OF THE DRAWINGS

In the Figures, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

Figure 1A:
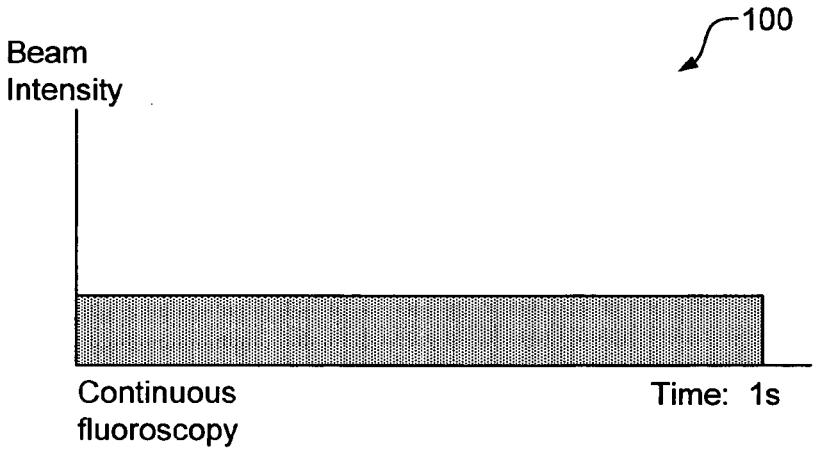
FIGS. 1A-1C illustrate exemplary fluoroscopic signals used in conventional systems for driving an x-ray beam in a fluoroscope.
Figure 1B:
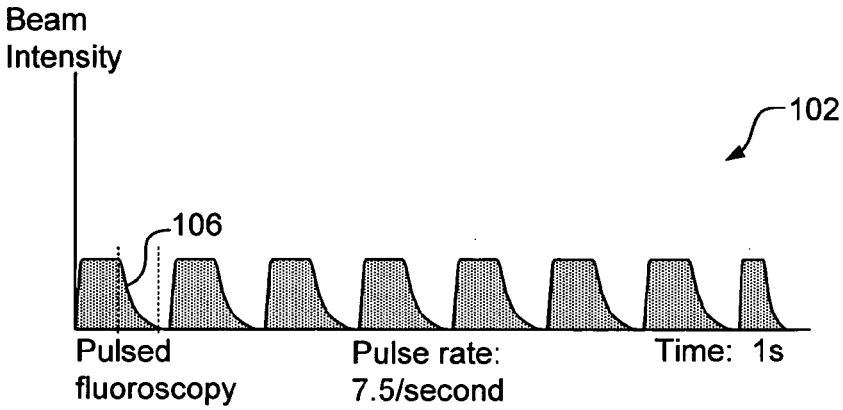

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Embodiments of systems and methods are described provide for generation of patient images that are of satisfactory quality, while reducing radiation exposure as compared to conventional systems. Some embodiments provide for bursted pulse progressive fluoroscopy. Various embodiments generate bursts of pulses, in which the pulses of each burst are generated at a higher pulse rate than traditional pulsed fluoroscopy. Some embodiments provide for modifying a first pulsed fluoroscopic signal, wherein each of the first pulses is divided into a plurality of pulses. As a result, embodiments can provide as good or better quality images than conventional systems, without increasing the radiation exposure rate.

Figure 2:
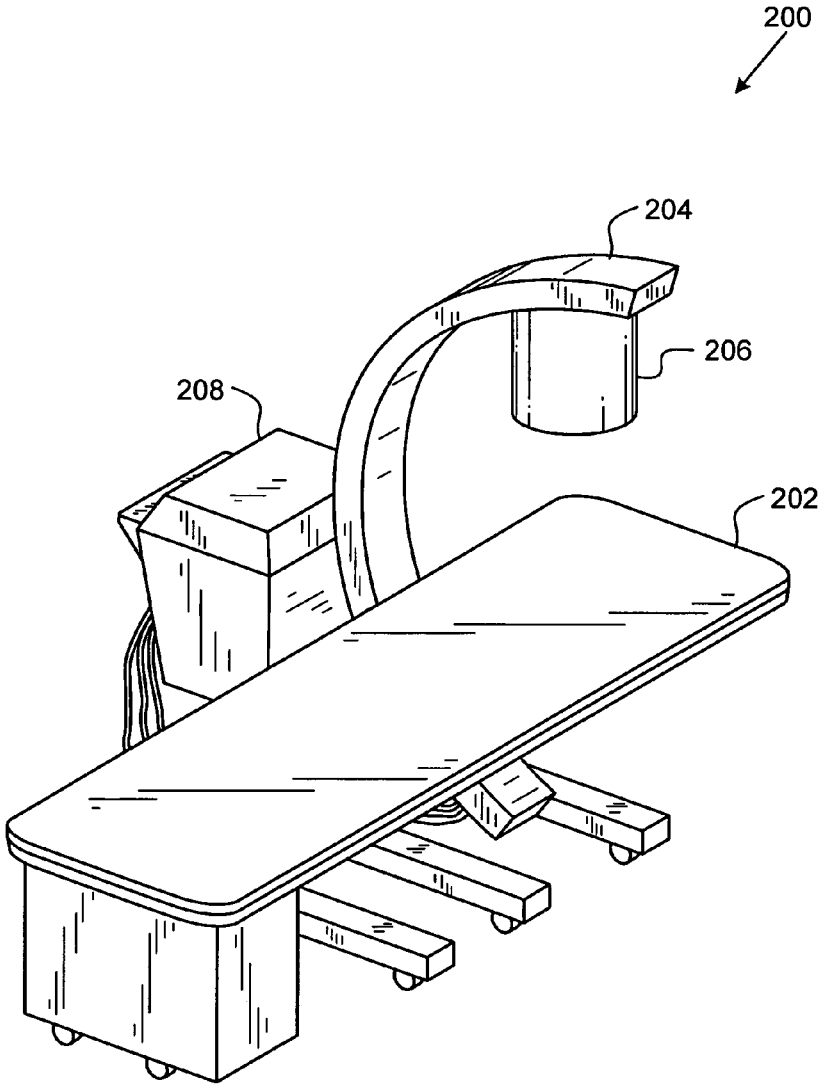
FIG. 2 is a perspective view of a scanner table positioned within an exemplary C-arm having a fluoroscopic apparatus mounted thereon.

FIG. 2 illustrates an exemplary scanning environment 200 in which embodiments of the present invention can operate. A scanner table (e.g., a radiolucent table) 202 is positioned within an exemplary C-arm 204. The C-arm 204 has an X-ray source, such as a scanner (e.g., a fluoroscope) 206 mounted thereon, such that when a patient (not shown) lies on the scanner table 202, X-rays emitted from the scanner 206 scan a relevant portion of the patient's body.

A component housing 208 includes one or more components that are communicably coupled to the C-arm 204 and the scanner 206. The components send signals to the C-arm 204 to cause the C-arm to move about the scanning table 202. Signals are also sent to the scanner 206 to cause X-rays to be emitted from the scanner 206. In one embodiment, the X-rays are emitted in bursted pulses. Exemplary embodiments of components in the component housing 208 are illustrated in the accompanying figures, and discussed in detail below.

A fluorescent screen (not shown) is positioned beneath the scanner table 202. The fluorescent screen receives the X-rays emitted by the scanner 206 to create an image of internal structures of the patient's body.

Figure 3:
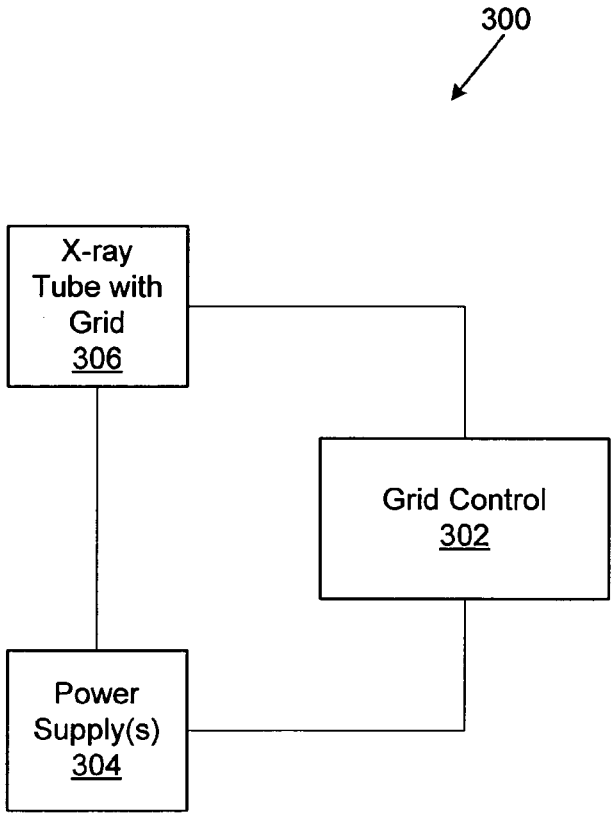
FIG. 3 is generalized functional module diagram illustrating modules in a system in accordance with one embodiment.

FIG. 3 is a functional block diagram illustrating modules in a fluoroscope system 300 that provides bursted pulse progressive fluoroscopy (BPPF) in accordance with one embodiment. The term bursted pulse progressive fluoroscopy generally refers to techniques for generating bursts of multiple pulses that can be used in controlling a grid associated with an ionizing radiation source (e.g., a fluoroscope X-ray tube). Although embodiments illustrated herein generate multiple bursts based on a conventional pulsed signal, embodiments need not receive or use a conventional pulsed signal to generate a bursted pulsed signal. In the simplified illustration of FIG. 3, a bursted pulse progressive grid controller 302 receives power from a power supply 304, and regulates the power to a grid in the X-ray tube 306.

Figure 5:
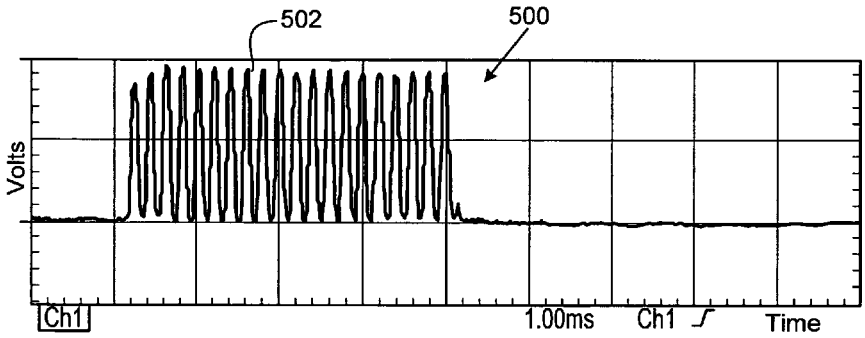
FIG. 5 is a chart illustrating multiple shorter pulses that are generated in place of a longer single pulse in accordance with one embodiment of the grid controller of FIG. 4.

Bursted pulse progressive grid controller 302 generates a bursted pulse signal, such as that shown in FIG. 5. The bursted pulse signal is input to a grid of the X-ray tube 306 to switch the grid on and off according to the bursted pulses.

Figure 4:
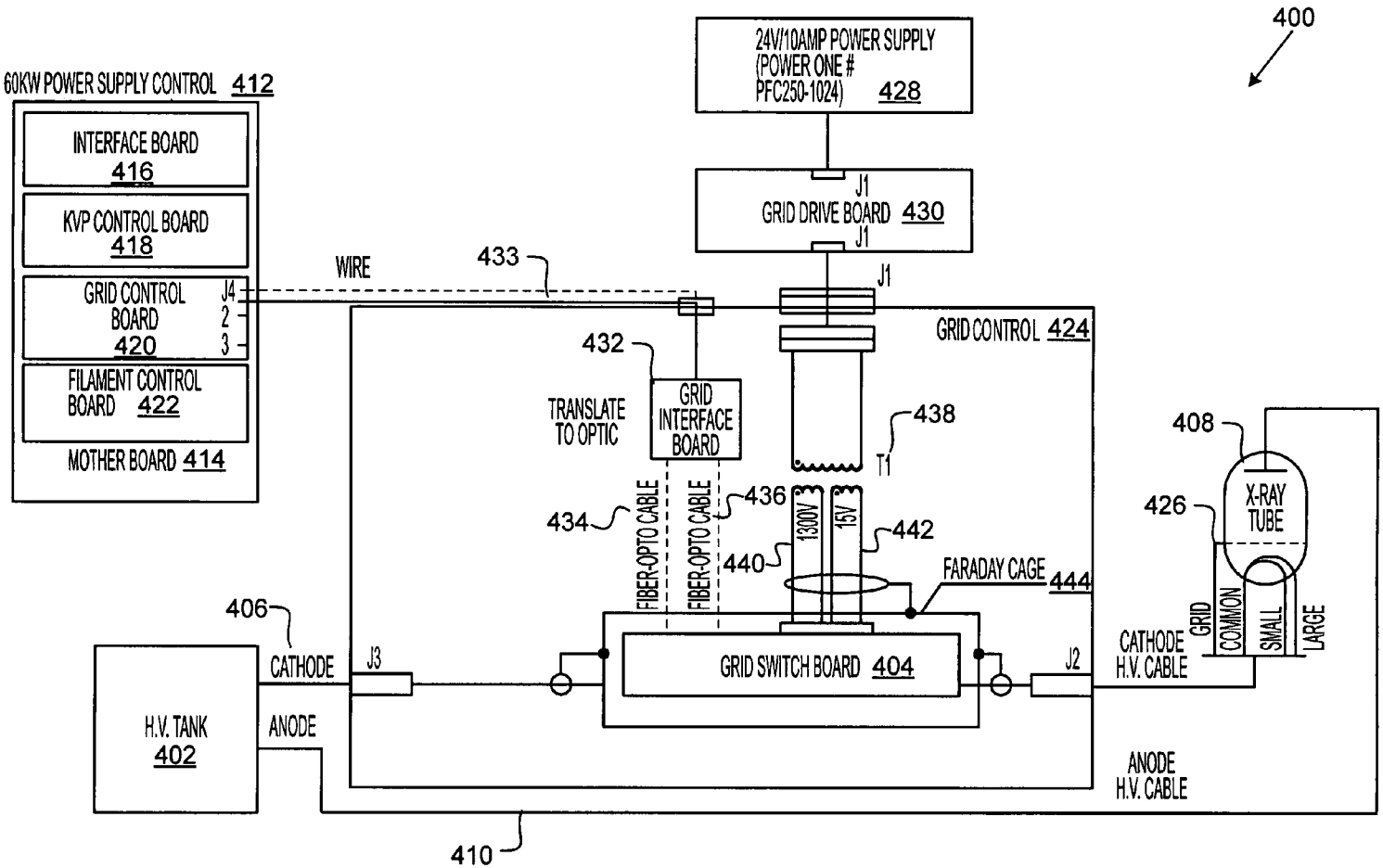
FIG. 4 is a schematic diagram illustrating a particular embodiment of a bursted pulse progressive fluoroscopic system in accordance with one embodiment.

FIG. 4 is a schematic diagram illustrating a bursted pulse progressive fluoroscopic system 400 in accordance with one embodiment. High voltage (HV) power supply (or tank) 402 is connected to grid switch board 404 via cathode 406 and is connected to the X-ray tube 408 via anode 410. In this embodiment, HV tank 402 can deliver 60 Kilowatts of power.

A power supply controller 412 includes modules for use in controlling the power delivery to, and usage by, the X-Ray tube 408. The power supply controller 412 can be, but is not required to be, implemented on a mother board 414. The power supply controller 412 includes an interface board 416, a KVP control board 418, a grid control board 420, and a filament control board 422.

The interface board 416 provides a user interface and handles data input and output. The user output is typically provided via an output screen or display (not shown), and buttons, or touch sensitive screen is typically provided for input. The interface board 416 controls the display screen and receives and processes input data. The interface board 416 may also provide other output functionality, such as driving a printer (not shown), or communicating data via a network.

Figure 1C:
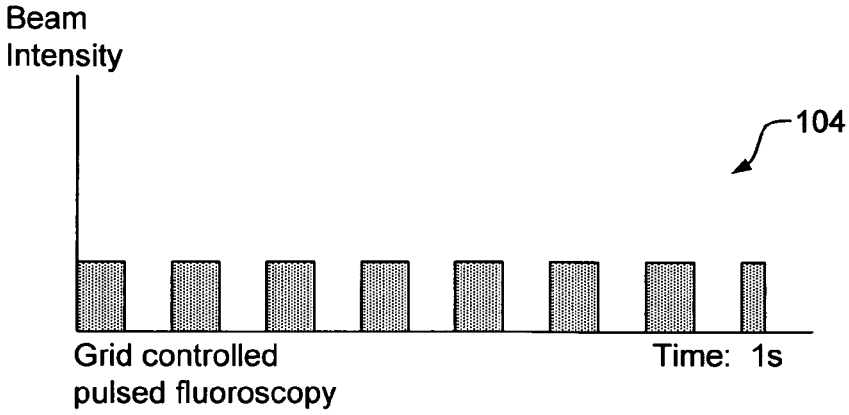

The KVP control board 418 controls the HV power tank 402. The filament control board 422 controls the filament in the X-ray tube 408. The grid control board 420 generates a pulsed signal that is used by the bursted pulse progressive grid controller 424 to control the grid 426 of the X-ray tube 408. Grid control board 420 can generate a conventional pulsed signal such as that shown in FIG. 1*c*. As discussed further below, the bursted pulse progressive grid controller 424 uses pulses of the signal from the grid control board 420 to generate another signal in which multiple pulses are generated in bursts.

A grid controller power supply 428 provides power to the bursted pulse progressive grid controller 424. In the embodiment shown, the power supply 428 is a 24 volt/10 Amp power supply. The output of the power supply 428 is input to a grid drive board 430, which prepares the power signal for delivery to the bursted pulse progressive grid controller 424.

The bursted pulse progressive grid controller 424 receives a signal, such as a conventional pulsed signal, from the grid control board 420. The signal from the grid control board 420 is an electrical signal 433 and is communicated to a grid interface board 432. The grid interface board 432 translates the electrical signal 433 from the grid control board 420 into a fiber optic signal. The fiber optic signal is communicated to a grid switch board 404 via one or more fiber optic cables 434, 436.

Power from the grid drive board 430 is applied to the grid switch board 404 via a three winding transformer 438. Transformer 438 has one winding 440 that generates 1300 volts, and another winding 442 that generates 15 volts. The grid switch board 404 is disposed in Faraday cage 444, to shield the grid switch board 404 from electromagnetic fields.

FIG. 5 illustrates a portion of an exemplary output BPPF signal 500 from the bursted pulse progressive grid controller 424. A burst of multiple pulses 502 is generated in a short period of time (e.g., 1 millisecond). Thus, for each pulse of a conventional grid control signal, multiple pulses can be generated. Only a portion of an output bursted pulse progressive signal is shown in FIG. 5. In actual operation, bursts of multiple pulses would be generated multiple times. The bursts may be generated at a selected duty cycle, such as, but not limited to, within a range of 20% to 70%.

Figure 6:
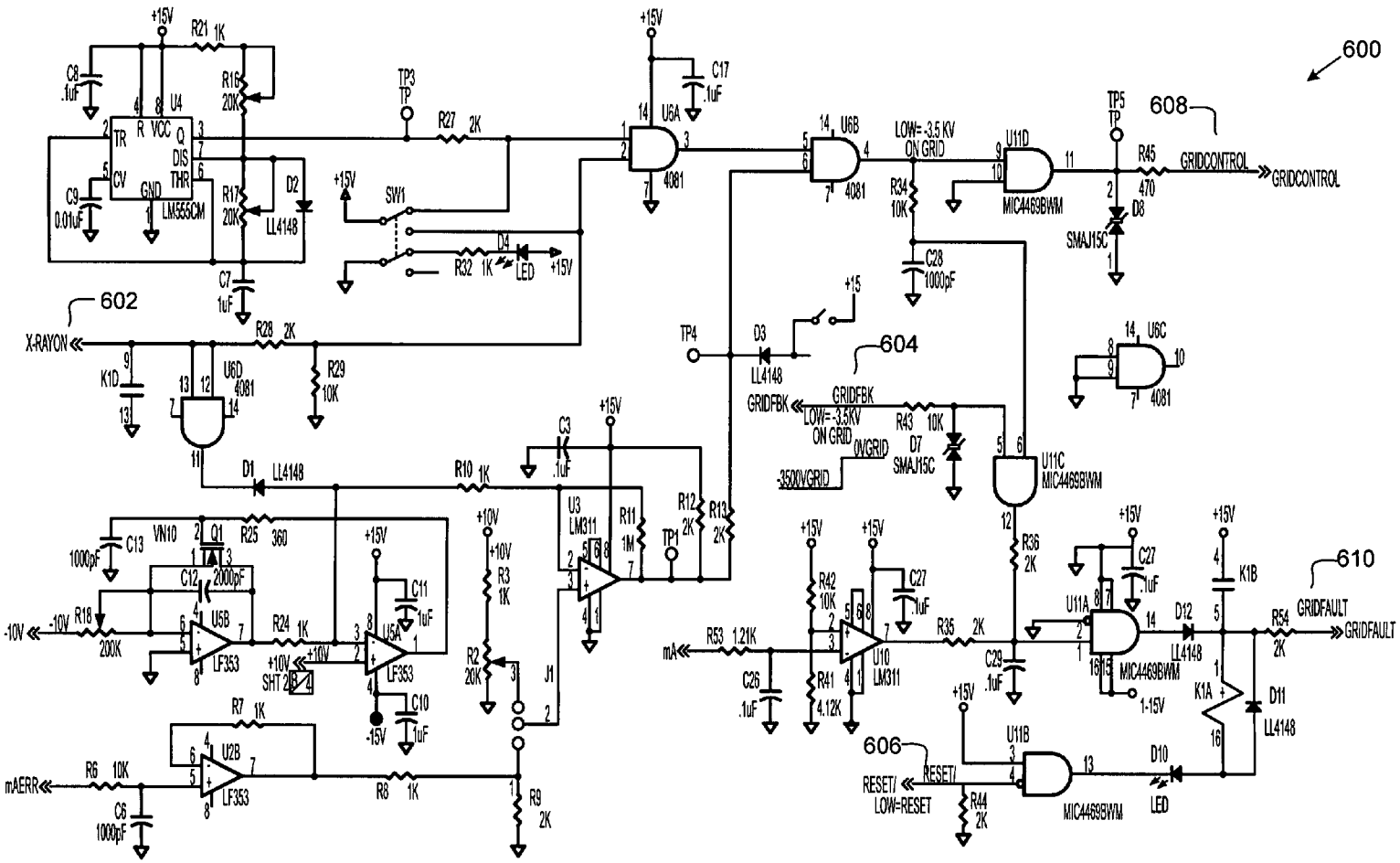
FIG. 6 illustrates an embodiment of a primary grid control circuit, which is operable to generate a series of grid pulses for controlling an X-ray grid, such as that shown in FIG. 3.

FIG. 6 illustrates an embodiment of a primary grid control circuit 600, which is operable to generate a series of grid pulses for controlling an X-ray grid. Generally, the circuit 600 includes logic and solid state electronics to generate five relevant output signals: X-ray on signal 602, grid on/off signal 604, reset signal 606, grid control signal 608, and grid fault signal 610. The particular details of the logic and electronics in circuit 600 are not discussed in detail, as those skilled in the art will appreciate the interconnections and interactions among those circuit components.

X-ray on signal 602 is input to the X-ray apparatus for turning the X-ray tube on and off. Grid on/off signal 604 represents and on and off control signal to the grid of the X-ray apparatus. In one embodiment, grid on/off signal can represent voltage values of −3500 volts and 0 volts. In this and other embodiments, the grid on/off signal is communicated via a fiber optic link and received by receiver 1002 shown in FIG. 10 and discussed further below. The circuit 600 works with the switch circuit 800 shown in FIG. 8, discussed below, to apply the switched voltages to the grid.

Reset signal 606 resets the grid. Grid control signal 608 is a pulsed signal at a conventional pulse rate (e.g., 12 pulses per second). The grid control signal 608 can be input into a bursted pulse progressive grid controller, which can generate a bursted pulse progressive signal using the grid control signal 608. Grid fault signal 610 indicates whether a fault has occurred in the grid.

Figure 7:
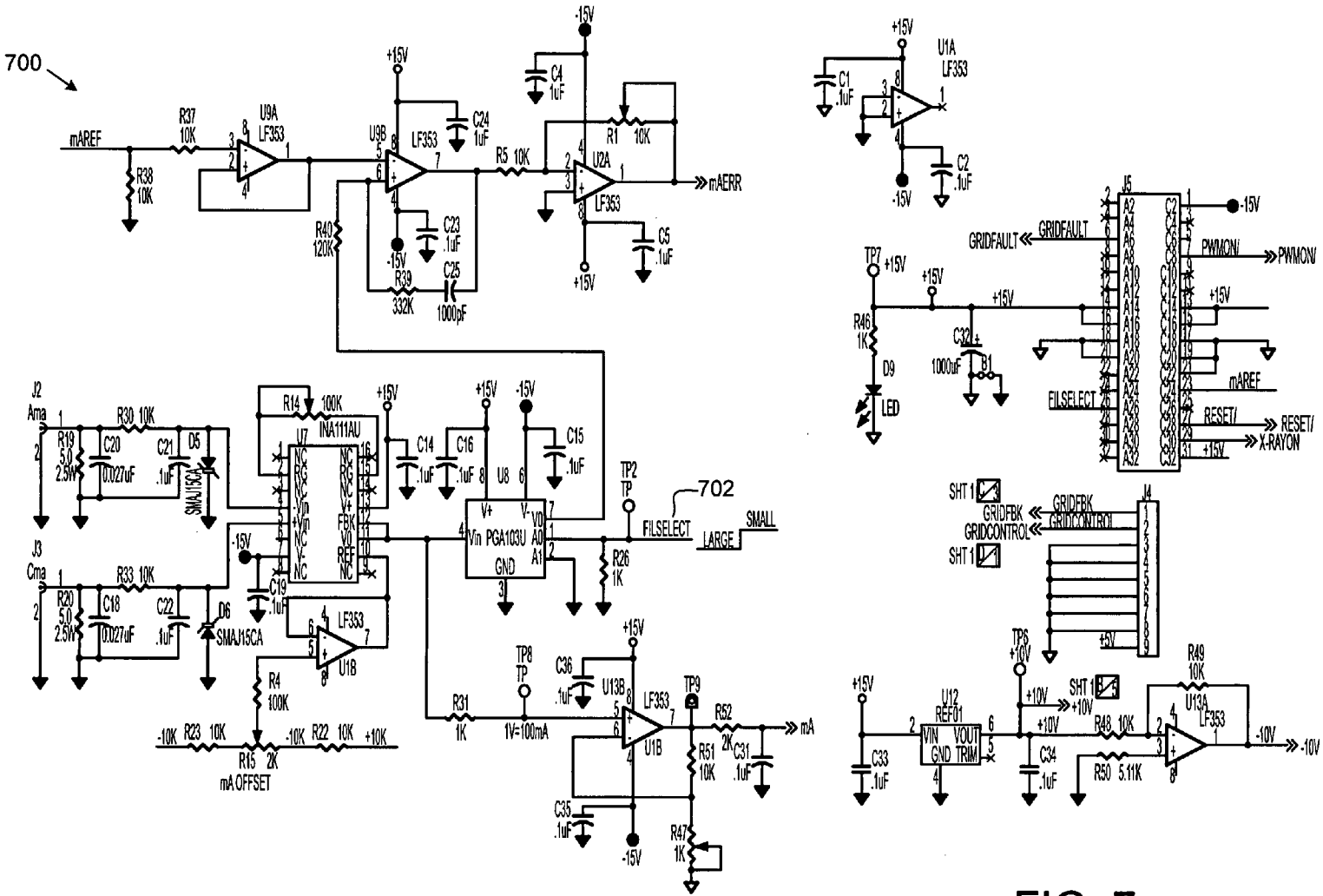
FIG. 7 illustrates other embodiments of circuits that can be used in the primary grid control board and/or the filament control board of FIG. 3.

FIG. 7 illustrates an embodiment of a circuit 700 that can be used in the primary grid control board and/or the filament control board of FIG. 3. A filament selection circuit 700 generates a filament select signal 702 used to select a large or small filament of the X-ray tube.

Figure 8:
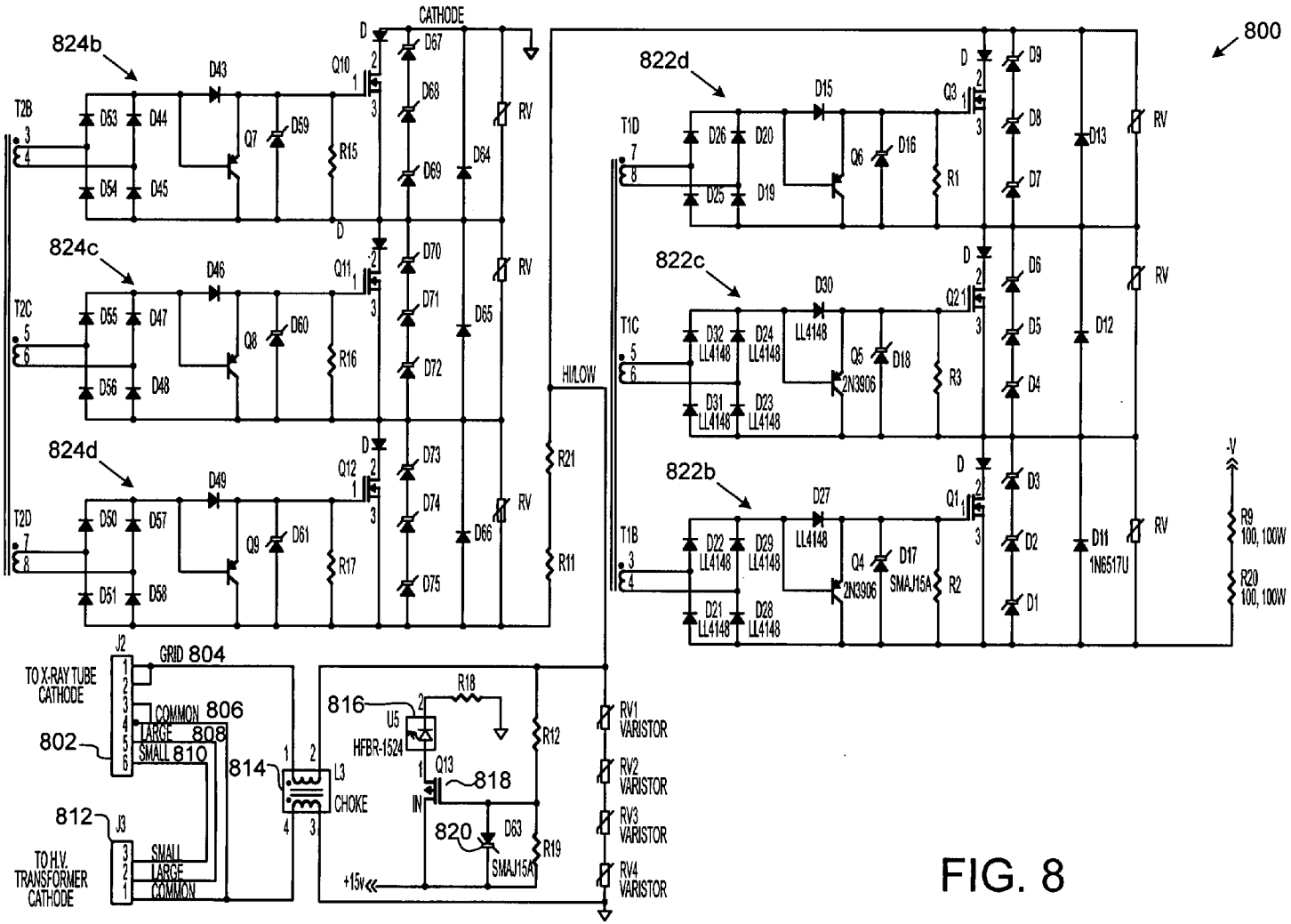
FIG. 8 is a schematic diagram illustrating one embodiment of portion of the grid switch module of FIG. 3 that interfaces with the grid interface board.

FIG. 8 is a schematic diagram illustrating one embodiment of a portion of the grid switch module 800 of FIG. 3 that interfaces with the grid interface board. In general, the circuit 800 controls voltage potential across the grid. In one embodiment, the circuit 800 switches voltage of the grid between a reference voltage (e.g., 0 volts) and a specified offset voltage (e.g., −3000 volts or −3500 volts). Junction J2 802 interfaces with the X-ray tube cathode and the grid. A grid signal 804, common signal 806, large filament signal 808, and small filament signal 810 are provided through junction J2 802. Small filament signal 810, large filament signal 808, and common signal 806 are connected to junction J3 812, which interfaces with the high voltage transformer cathode.

Grid signal 804 and common signal 806 are connected to choke 814, which provides inductance to choke off alternating currents, for example, radio frequencies that may arise in the signals. Opposite terminals of the choke 814 are connected to a fiber optic portion including a fiber optic connector 816. Rectifier 818 converts alternating current (AC) to direct current (DC), and transient voltage suppressor 820 reacts to sudden overvoltage conditions to suppress power disturbances that could damage components.

Terminals of transformer coils T1B, T1C, T1D, T2B, T2C, and T2D connect to power switching circuits 822*b*, 822*c*, 822*d*, 824*b*, 824*c*, and 824*d*, respectively. Power switching circuits 822*b-d*, and 824*b-d* provide relative voltages from which a bursted pulse progressive grid signal can be generated.

Figure 9:
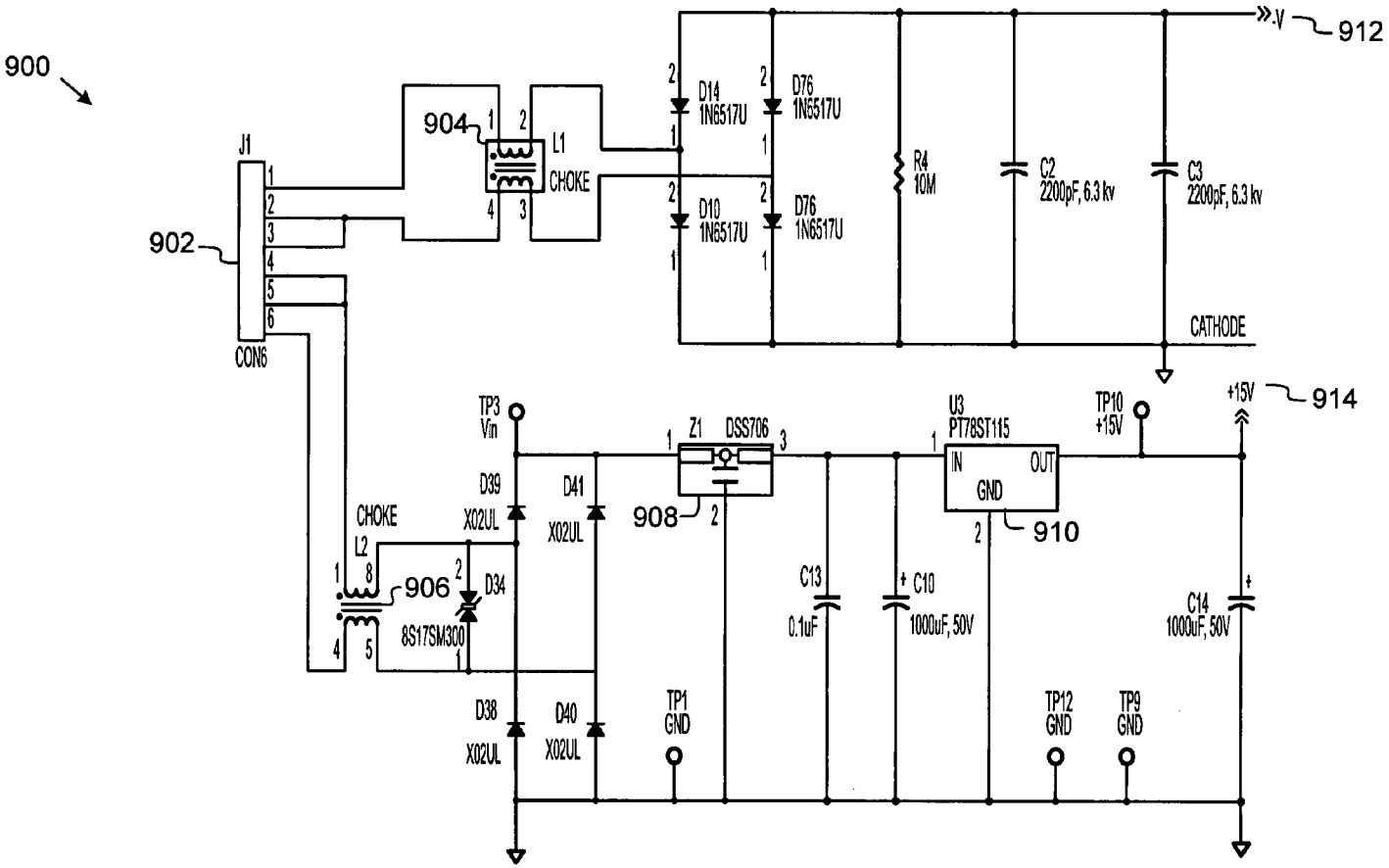
FIG. 9 illustrates a portion of a grid switch controller that receives input power and generates voltages for use by circuit components, and a fluoroscope grid and/or filaments.

FIG. 9 illustrates a portion 900 of a grid switch controller that receives input power and generates two voltages: a first voltage that provides power to circuit components, and a second voltage that is used to generate a power signal to the fluoroscope grid and/or filaments. Junction J1 902 connects the circuit 900 to a power supply, which may provide 24 volts at 10 amps. Choke 904 and choke 906 facilitate suppression of alternating currents.

Varistor-capacitor 908 suppresses noise emission from electronic equipment while controlling incoming surges from static electricity, and thereby protects circuit 900 from electrical surges and acts as a filter for signal lines. Integrated Switching Regulator (ISR) 910 provides line and load regulation with internal short-circuit and over-temperature protection. A first output voltage 912, labeled −V, can be used to control voltages to the fluoroscope grid. A second output voltage 914 can be used as power to circuit components.

Although particular values and types of circuit components are illustrated, those skilled in the art will understand that embodiments are not limited to the particular values and types of components shown. Rather, many variations are possible within the scope of the invention. By way of example, but not limitation, the functionality of the described circuits may be implemented in an application-specific integrated circuit (ASIC), firmware, and/or a processor (e.g., a microprocessor, microcontroller, or digital signal processor) executing instructions stored in memory.

Figure 10:
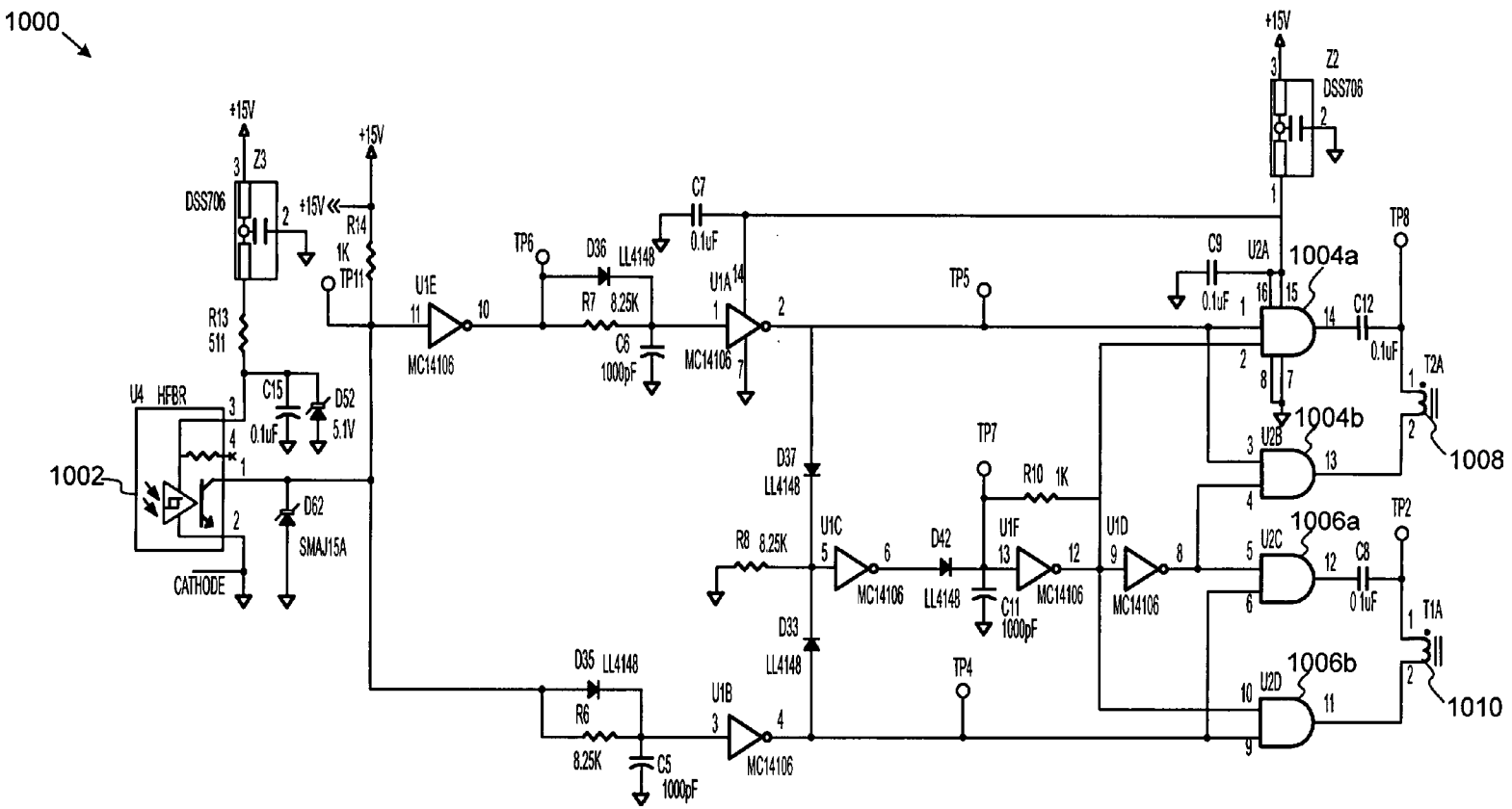
FIG. 10 is another portion of a grid switch control circuit that can be used to convert fiber optic signals from a grid controller into electrical signals for use by a grid switch control module.

FIG. 10 is another portion of a grid switch control circuit 1000 for controlling a grid of a fluoroscope. Fiber optic signals representing voltages to the grid are input to a fiber optic receiver 1002. For example, in one embodiment, grid on/of signal 604 from the control circuit 600 (FIG. 6) described above is received by receiver 1002. The optical signals are converted to corresponding electrical signals that are applied to the circuit 1000. Output drivers 1004 and 1006 generate high frequency signals which drive gate transformers 1008 and 1010, respectively. In one embodiment, when gate transformer 1008 is driven, a low offset voltage (e.g., −3000 volts or −3500 volts) is applied to the grid. In this embodiment, if gate transformer 1010 is driven, a base voltage (e.g., 0 volts) is applied to the grid. The base voltage in this embodiment is equal to the cathode voltage.

Figure 11:
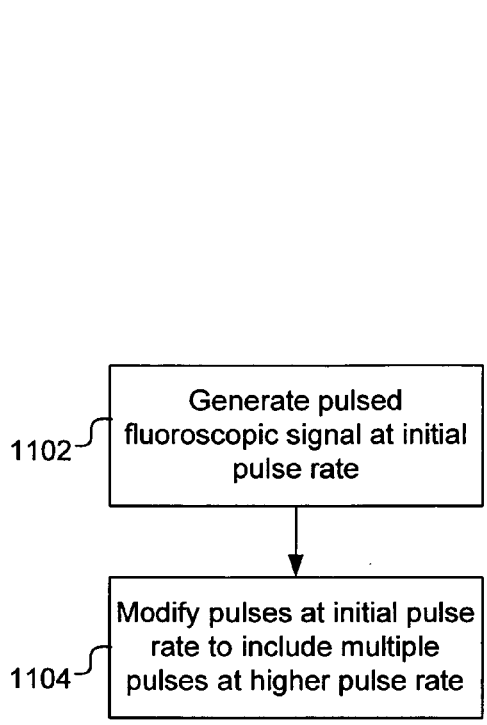
FIG. 11 a flowchart illustrating an algorithm that can be carried out to generate bursts of multiple pulses for use in controlling a grid.

FIG. 11 a flowchart illustrating an algorithm 1100 that can be carried out to generate bursts of multiple pulses. In a generating operation 1102, a pulsed control signal is generated at an initial pulse rate. A modifying operation 1104 modifies the initial signal by including multiple pulses at each initial pulse. The multiple pulses are at a predetermined higher rate than the initial pulse rate.

In tests of embodiments of the invention, the following comparison data was gathered:

Test 1: Conventional Pulsed Fluoroscopy:
75 kV
3.2 mS pulse width
30 fps
Radiation Output: 402 mR/min Test 2: Bursted Pulse Progressive Fluoroscopy:
78 kV
3.6 mS pulse width
30 fps
Radiation Ouput: 277 mR/min The results of the foregoing tests included images for each test that were virtually indistinguishable. Image quality and brightness were very similar between respective images of the two tests. Additional tests were performed with similar results. These tests are shown here:

Test 3: Conventional Pulsed Fluoroscopy:
83 kV
3.2 mS pulse width
30 fps
Radiation Output: 484 mR/min Test 4: Bursted Pulse Progressive Fluoroscopy:
87 kV
3.5 mS pulse width
30 fps
Radiation Ouput: 350 mR/min FIG. 12 is a snapshot of an image captured using conventional fluoroscopy using 67 kV and delivering 1.9 R/min.

Figure 12:
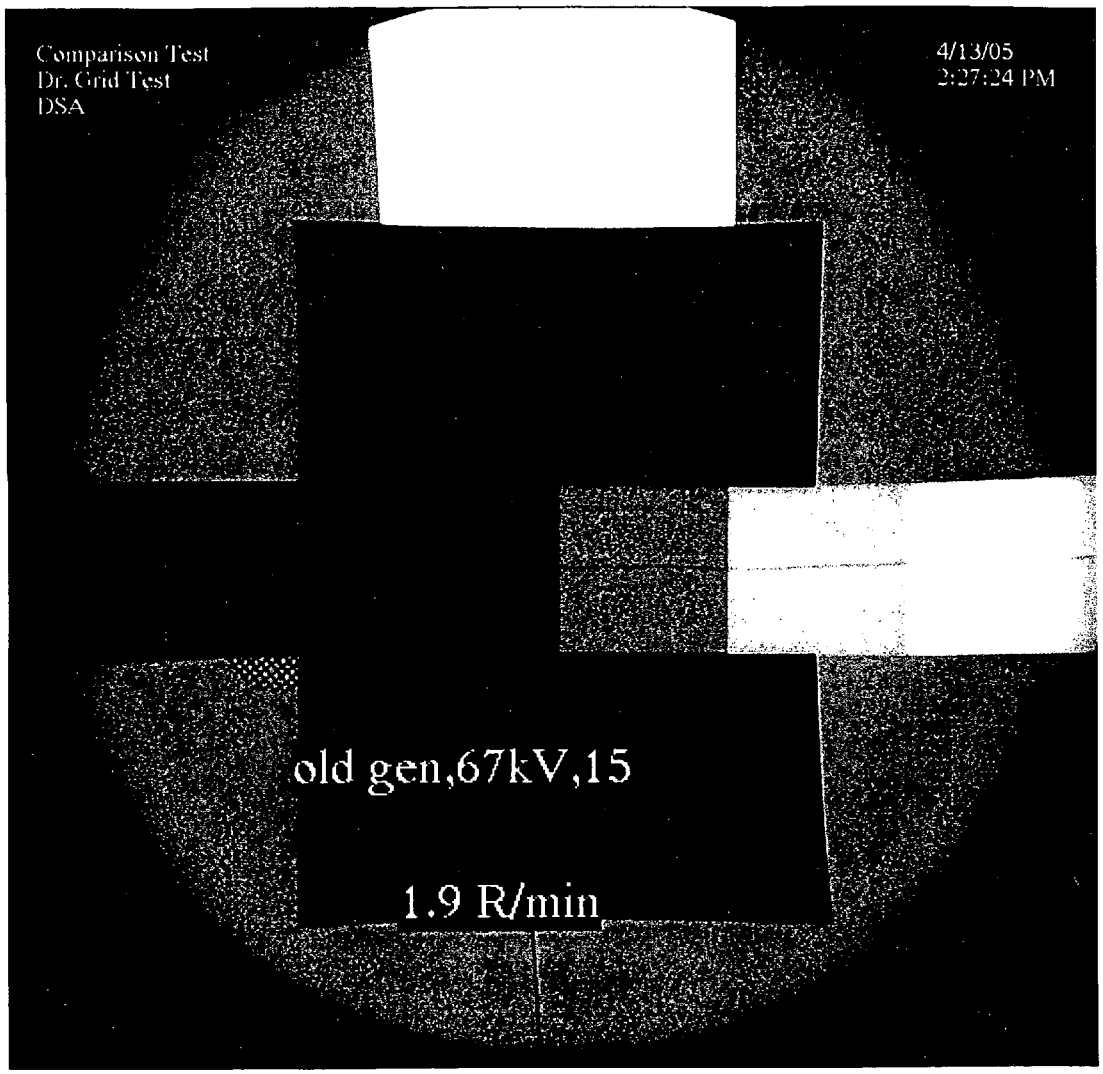
FIG. 12 is a copy of a snapshot of an image captured using conventional fluoroscopy using 67 kV and delivering 1.9 R/min.
Figure 13:
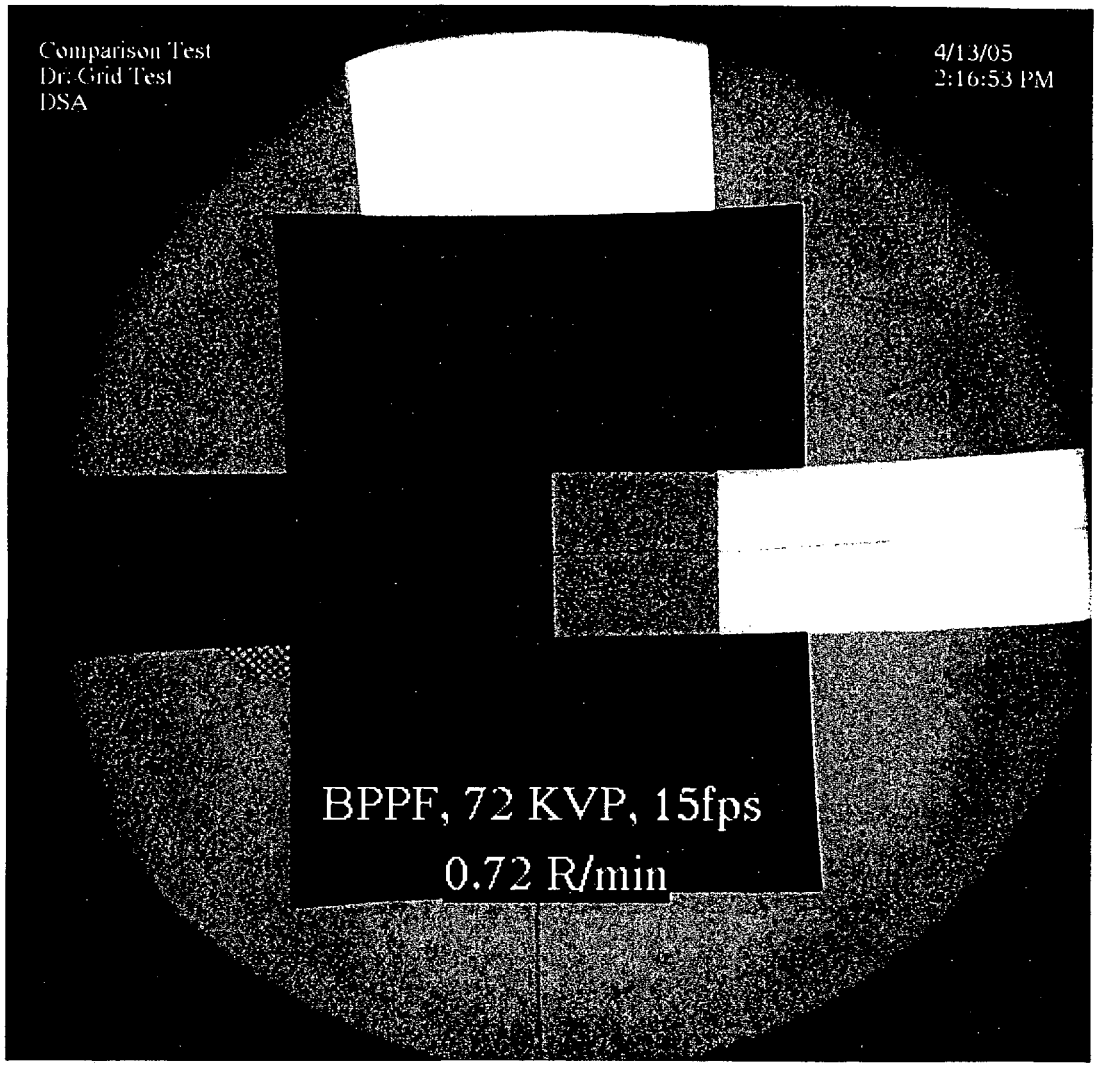
FIG. 13 is a copy of a snapshot of the image captured in FIG. 12, but using bursted pulse progressive fluoroscopy (BPPF)

FIG. 13 is a snapshot of the image captured in FIG. 12, but using a bursted pulse progressive fluoroscopy (BPPF) signal produced by a grid controlling components as illustrated in FIGS. 3-10. The parameter settings associated with the image are 72 kVP, 15 fps, and 0.72 R/min. It will be appreciated by those skilled in the art that the snapshot shown in FIG. 13 is of at least the same quality as that shown in FIG. 12, and with a lower ionizing radiation emission rate.

Figure 14:
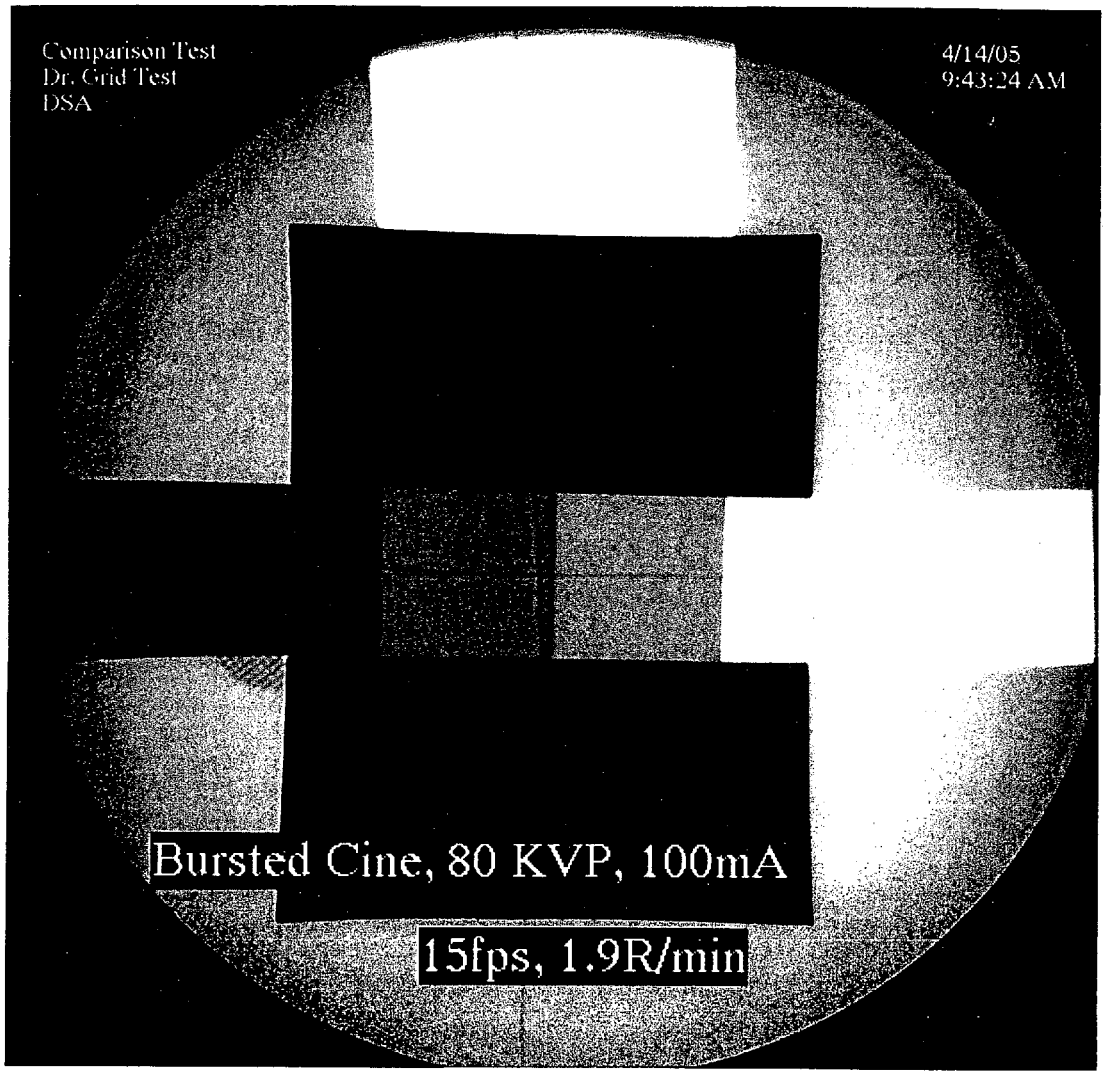
FIG. 14 is a copy of a snapshot of the image captured in FIG. 12, but using bursted pulse progressive fluoroscopy (BPPF).

FIG. 14 is another snapshot of the image captured in FIG. 12, but using a BPPF signal produced by a grid controller components as illustrated in the associated figures and described in detail above. The parameter settings associated with the image are 80 kVP, 100 mA, 15 fps, and 1.9 R/min. It will be appreciated by those skilled in the art that the snapshot shown in FIG. 14 is of at least the same quality as that shown in FIG. 12, while delivering more power with the same rate of ionizing radiation emission.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

I claim:

1. An X-ray imaging system comprising:

an X-ray source operable to generate an X-ray beam;

an X-ray receiver receiving the X-ray beam;

a power generator generating power to the X-ray source to generate the X-ray beam;

a grid disposed between a cathode and an anode of the X-ray source;

a first pulse generator generating a first signal comprising first multiple pulses at a first pulse rate, each of the first multiple pulses having a pulse width; and a second pulse generator coupled to the grid and the power generator, the second pulse generator generating a second signal comprising second multiple pulses at a second pulse rate higher than the first pulse rate during each pulse width of the first multiple pulses, wherein the second signal is communicated to the grid to cause the X-ray beam to pulse on and off in accordance with the second signal during imaging.

2. An X-ray imaging system as recited in claim 1 wherein the second pulse generator generates the second signal by receiving the first signal and replacing each of the first multiple pulses with the second multiple pulses at the second pulse rate.

3. An X-ray imaging system as recited in claim 1 wherein the X-ray imaging system is a fluoroscope.

4. An X-ray imaging system as recited in claim 1 wherein the first pulse generator comprises a computer and the second pulse generator comprises a modular assembly configured for coupling to a communications port of the computer.

5. An X-ray imaging system as recited in claim 1 wherein the first pulse rate is in a range extending from one to thirty pulses per second.

6. An X-ray imaging system as recited in claim 1 wherein the second pulse rate is adjustable.

7. An X-ray imaging system as recited in claim 1 wherein the second pulse rate is in a range extending from 2 kiloHertz (kHz) to 20 kHz.

8. An X-ray imaging system as recited in claim 1 wherein power from the power generator to the X-ray source remains substantially unchanged during imaging.

9. An X-ray imaging system as recited in claim 1 wherein a radiation exposure rate associated with imaging is in a range extending from 0.1 Roentgen (R) per minute to 2.0 R per minute.

10. An X-ray imaging system as recited in claim 1 wherein the second pulse generator is interconnected to at least one of the anode and the cathode.

11. An X-ray imaging system as recited in claim 1 wherein the second pulse generator is interconnected to the cathode.

12. A grid controller for a grid controlled pulsed fluoroscopic apparatus having an x-ray tube generating an x-ray beam, an x-ray receiver receiving the x-ray beam, a high voltage power supply having an anode and a cathode, the anode connected to the x-ray tube, the x-ray tube including a grid operable to regulate the x-ray beam from the x-ray tube, the fluoroscopic apparatus further comprising a computing device generating a first pulsed fluoroscopic signal at a first pulse rate, the grid controller comprising:

a grid interface connected to the computing device and receiving the first pulsed fluoroscopic signal therefrom;

a grid switch module connected to the cathode of the high voltage power supply, further connected to the grid interface and receiving the first pulsed fluoroscopic signal therefrom, the grid switch module generating a second fluoroscopic signal by dividing each of the pulses in the first fluoroscopic signal into a plurality of second pulses at a higher pulse rate than the first pulse rate, wherein the x-ray beam is thereby pulsed from the X-ray tube according to second pulses in the second fluoroscopic signal.

13. A grid controller as recited in claim 12 wherein the first fluoroscopic signal from the computing device is an electric signal transmitted via wire, and wherein the grid interface translates the electric signal into an optical signal transmitted to the grid switch module via fiber-optic cable.

14. A grid controller as recited in claim 12 wherein the grid switch module enables adjustment of the second pulse rate.

15. A grid controller as recited in claim 12 wherein the second pulse rate is in a range from 2 kHz to 20 kHz.

16. A grid controller as recited in claim 12 wherein pulsing of the x-ray beam according to the second pulses result in a radiation exposure rate in a range from 0.1 Roentgen (R) per minute to 2.0 R per minute.

17. A grid controller as recited in claim 12 wherein the grid interface and the grid switch module are housed in a casing having a first communications port coupled to the grid interface, wherein the first communications port is compatible with a second communications port of the communications device.

18. A grid controller as recited in claim 12 wherein the high voltage power remains substantially unchanged during pulsing of the x-ray beam.

19. A method for controlling an x-ray beam generated by an x-ray source in a fluoroscope, the fluoroscope comprising an x-ray receiver disposed opposite the x-ray source, and a grid disposed between a cathode and an anode of the X-ray source, the method comprising:

generating a first pulsed fluoroscopic signal having a first plurality of pulses at a first pulse rate;

based on the first pulsed fluoroscopic signal, generating a second pulsed fluoroscopic signal, wherein for each of the first plurality of pulses, a second plurality of pulses is generated at a second pulse rate higher than the first pulse rate; and driving voltage of the grid using the second pulsed fluoroscopic signal, wherein the second pulsed fluoroscopic signal is communicated to the grid to cause the X-ray beam to pulse on and off in accordance with the second pulsed fluoroscopic signal during imaging.

20. A method as recited in claim 19 wherein generating the second pulsed fluoroscopic signal comprises replacing each of the first plurality of pulses with a second plurality of pulses at the second pulse rate.

21. A method as recited in claim 19 wherein driving voltage of the grid comprises:

receiving high power voltage from a high power voltage source; and modulating the high power voltage with the second pulsed fluoroscopic signal.

22. A method as recited in claim 19 wherein generating the second pulsed fluoroscopic signal comprises generating the second plurality of pulses at a pulse rate ranging from 2 kHz to 20 kHz.

23. A method as recited in claim 19 wherein the first pulse rate ranges from one pulse per second to 30 pulses per second.

24. A method as recited in claim 19 wherein the first fluoroscopic pulsed signal is received via a wire, the method further comprising converting the first fluoroscopic pulsed signal to an optical signal.

25. A method as recited in claim 19 wherein the first fluoroscopic pulsed signal is received via an interconnection to the cathode.

26. A method as recited in claim 19 further comprising:

utilizing a grid controller to complete the steps of generating the second pulsed fluoroscopic signal and driving voltage of the grid.

27. A method as recited in claim 26, wherein the grid controller includes a grid interface, the method further comprising:

receiving the first pulsed fluoroscopic signal at the grid interface.

28. A method as recited in claim 26, wherein the grid controller includes a grid switch module, the method further comprising:

receiving the first pulsed fluoroscopic signal at the grid switch module, wherein the step of generating the second pulsed fluoroscopic signal is performed by the grid switch module by dividing each of the pulses in the first fluoroscopic signal.

29. A method as recited in claim 28, wherein the grid switch module is connected to a cathode of a high voltage power supply.

* * * * *